US005607283A

United States Patent [19]

Kato et al.

[11] Patent Number: 5,607,283

[45] Date of Patent: Mar. 4, 1997

[54] WESTCO-TYPE FUEL PUMP HAVING IMPROVED IMPELLER

[75] Inventors: Takahiko Kato, Kariya; Motoya Ito, Anjo, both of Japan

[73] Assignee: Nippondenso Co., Ltd., Kariya, Japan

[21] Appl. No.: 525,116

[22] Filed: Sep. 8, 1995

Related U.S. Application Data

[63] Continuation of Ser. No. 208,513, Mar. 10, 1994.

[30] Foreign Application Priority Data

Mar. 30, 1993 [JP] Japan ..... 5-071752

[51] Int. Cl.[6] ..... F04D 5/00

[52] U.S. Cl. ..... 415/55.1

[58] Field of Search ..... 415/55.1, 55.2, 415/55.3, 104, 174.3

[56] References Cited

FOREIGN PATENT DOCUMENTS 450362 10/1991 European Pat. Off. .

57-114195 7/1982 Japan .

57-171092 10/1982 Japan .

58-2495 1/1983 Japan .

58-197495 11/1983 Japan .

60-85284 5/1985 Japan .

*Primary Examiner*—Edward K. Look

*Assistant Examiner*—Michael S. Lee

*Attorney, Agent, or Firm*—Cushman, Darby & Cushman IP Group of Pillsbury Madison & Sutro LLP

[57] ABSTRACT

A disk-shaped impeller having on its periphery a multiple radial vanes and a multiple radial impeller grooves is rotatably disposed in a pump housing. On each end surfaces of the impeller there are formed a plurality of C-shaped grooves. As the impeller is rotated at a higher speed, the fluid in the C-shaped grooves in the impeller acquires a velocity component in an impeller's axial direction to generate a force sufficient to push a pump cover and a pump casing in the axial direction. Accordingly, since it is avoided for the impeller to adhere either the pump cover or the pump casing, the space between the impeller and the housing inner wall is reduced while the possible leakage of the fluid is reduced.

21 Claims, 6 Drawing Sheets

WESTCO-TYPE FUEL PUMP HAVING IMPROVED IMPELLER

This is a continuation of application Ser. No. 08/208,513, filed on Mar. 10, 1994.

BACKGROUND OF THE INVENTION

1. Field of the Invention

The present invention relates to a Westco-type pump, which is suitable, for example, as an automobile fuel pump. The "Westco-type pump" referred herein is also called a vortex pump, a regenerative pump or a periphery pump.

2. Related Art Statement

The Westco-type pump makes use of an impeller which is a disk formed on its entire periphery with a multitude of recesses. A pumping action is effected in a working passage surrounding a portion of the periphery of the impeller. One end of the working passage is communicated via an intake passage with a suction tube and the other end is communicated via a discharge passage with a discharge tube. There is a partition between the discharge passage and the intake passage. There is formed an extremely small radial space between an outer periphery of the impeller and an inner periphery of the partition, and an extremely small axial space (a side clearance) between a radial inward end surface portion of the impeller and a radial inward inner surface portion of a casing.

According to the conventional Westco-type pump, when the side clearance between the impeller and the casing is reduced, the pumping efficiency is increased because the leakage of the fluid is reduced. On the other hand, however, there is a possibility that a linking phenomenon occurs in which the impeller and the casing adhere to each other. The "linking phenomenon" is explained as follows. A strong force is required to separate two surfaces which are close to each other when such surfaces are machined at high flatness, since there is no flow of fluid therebetween. This phenomenon can occur between the impeller and the casing of the pump. When the linking phenomenon takes place, the sliding resistance is substantially increased and then the pumping efficiency is deteriorated. For this reason, there has hitherto been a limitation to reduce the side clearances between the impeller and the casing.

In order to resolve this problem, several efforts have been made heretofore. For example, Japanese Unexamined Patent Publication No. 58-19745 discloses a recess provided in an inner surface of the casing for generating an axial force urging the impeller, thereby improving the pumping efficiency. Japanese Unexamined Patent Publication No. 58-2495 discloses a spiral groove formed on an end surface of the impeller so as to reduce the thrust load acting on the impeller. Japanese Unexamined Utility Model Publication No. 57-114195 discloses a number of spiral grooves formed on an end surface of the impeller and an inner surface of the casing. Further, Japanese Unexamined Patent Publication No. 60-85284 discloses a wedge-shaped layer formed between an inner wall of the housing and a sliding surface of the impeller, thereby reducing the wear of the impeller.

However, the impeller configurations according to these prior art devices are incapable of producing a sufficiently uniform fluid film in the side clearance formed between an end surface of the impeller and an inner surface of the housing and does not significantly suppress the generation of the linking phenomenon. Especially, in case that the spiral grooves are formed on the end surface of the impeller, an unbalance of the fluid is positively created within the seal surface region so that the impeller tends to incline due to a slight pressure difference or the like.

SUMMARY OF THE INVENTION

A comparative experimentation by the present inventors shows that the specific configuration of the C-shaped grooves formed in an impeller improves the pumping efficiency remarkably, compared with those obtained by the prior art devices.

It is accordingly an object or the present invention to provide a Westco-type pump in which a substantially uniform fluid film is formed in the side clearance between an end surface of the impeller and an inner surface of the casing to prevent the impeller from being inclined while making sure that the impeller can skim over the inner surface of the casing, thereby suppressing the generation of the linking phenomenon.

To this end, according to the present invention, there is provided A Westco-type pump for pressurizing a fluid comprising: a casing having a partial annular pumping chamber connecting an intake port and a discharge port, the casing provided at opposite inner wall surfaces thereof with seal surfaces located radially inward of the pumping chamber; and an impeller rotatably disposed within the casing and having a plurality of vanes facing the pumping chamber and end surfaces apart from the seal surface of the casing by small spaces, characterized in that the impeller is provided with grooves which are formed in a portion of the end surface of the impeller facing the seal surface of the casing, and the grooves extend radially to be inclined with respect to a direction of rotation of the impeller, for concentrating fluid between the end surfaces of the impeller and the seal surfaces of the casing to counter rotation edge portions of the grooves so as to flow towards the seal surfaces, and that the grooves are predetermined such that the fluid concentrations is in a substantially uniform fluid pressure distribution with respect to a radial center circle of the seal surface.

DETAILED DESCRIPTION OF THE PREFERRED EMBODIMENTS

A first embodiment of the present invention which is applied to an automobile fuel feeding pump will be described in connection with FIGS. 1 and 2. The fuel feeding pump onto which a filter (not shown) is mounted is used to be disposed in a fuel tank.

Figure 2:
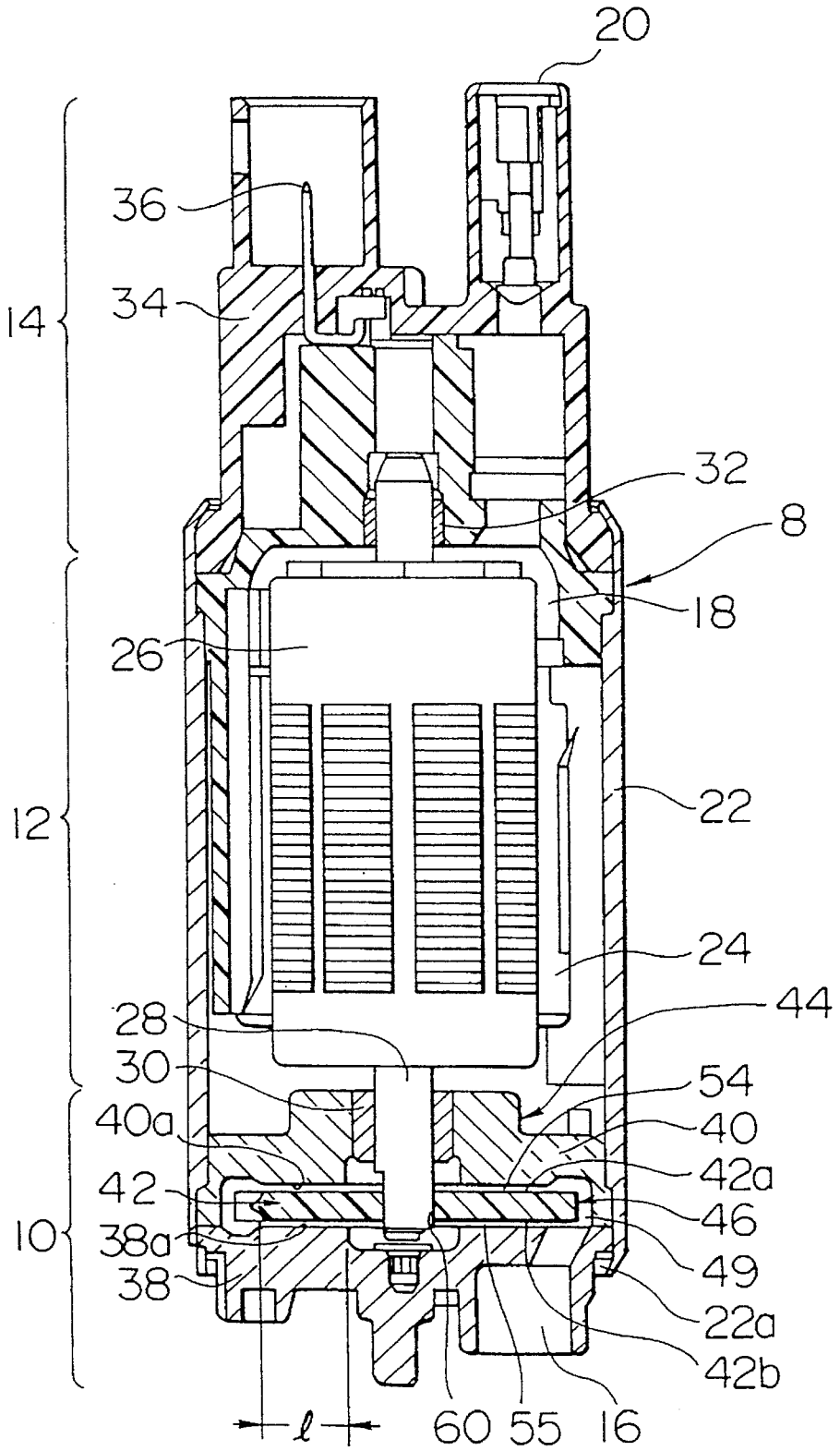
FIG. 2 is a longitudinal sectional view of a Westco-type pump according to a first embodiment of the present invention.

In FIG. 2, the fuel pump 8 comprises a pump portion 10, a motor portion 12 and a discharge portion 14. Fuel introduced through an intake port 16 of the pump portion 10 passes through a motor chamber 18 of the motor portion 12 and is discharged out of the pump 8 through a discharge port 20 of the discharge portion 14.

The motor portion 12 includes a permanent magnet 24 and an armature 26 which are coaxially accommodated within a cylindrical pump case 22. The permanent magnet 24 is secured to an inner wall of the pump case 22 and the armature 26 has a driving shaft 28 rotatably supported by means of bearings 30 and 32. A brush (not shown) is slidably contacted to the armature 26 and is electrically connected to a terminal 36 secured to an end cover 34. This end cover 34 is provided with the discharge port 20 of the discharge portion 14.

The pump portion 10 includes a pump housing 44 secured to an opening portion 22*a* of the pump case 22. The pump housing 44 has a pump cover 38 and a pump casing 40. In a disk-like space 46 formed between the inner wall surface 38*a* of the pump cover 38 and the inner wall surface 40*a* of the pump casing 40, there is disposed rotatably a disk-like impeller 42. Further, a peripheral portion of the space 46 is formed into a C-shaped pumping chamber 49 along the periphery of the impeller 42. The impeller 42 is fitted to an end portion of the driving shaft 28 rotatably supported by the bearings 30 secured to the pump casing 40. Accordingly, the impeller 42 is axially movable. When the impeller 42 is rotated integrally with the driving shaft 28, the fuel introduced from the intake port 16 of the pump cover 38 passes through the pumping chamber 49 into the motor chamber 18 from a discharge port (not shown) of the pump casing 40.

Between the inner wall surface 40*a* of the pump casing 40 and one end surface 42*a* of the impeller 42 and between the inner wall surface 38*a* of the pump cover 38 and the other end surface 42*b* of the impeller 42, there are spaces 54 and 55, respectively, which are substantially identical to each other. Here, the space 54 is defined between a seal surface formed at the inner wall surface 40*a* of the pump casing 40 and the end surface 42*a* of the impeller 42 whereas the space 55 is defined between a seal surface formed at the inner wall surface 38*a* of the pump cover 38 and the end surface 42*a* of the impeller 42. The seal surfaces are formed in an annular configuration, respectively within an annular area having a radial dimension 1 as shown in FIGS. 1 and 2. By rendering the spaces 54 and 55 small, the fuel is confined within the pumping chamber 49.

Figure 1:
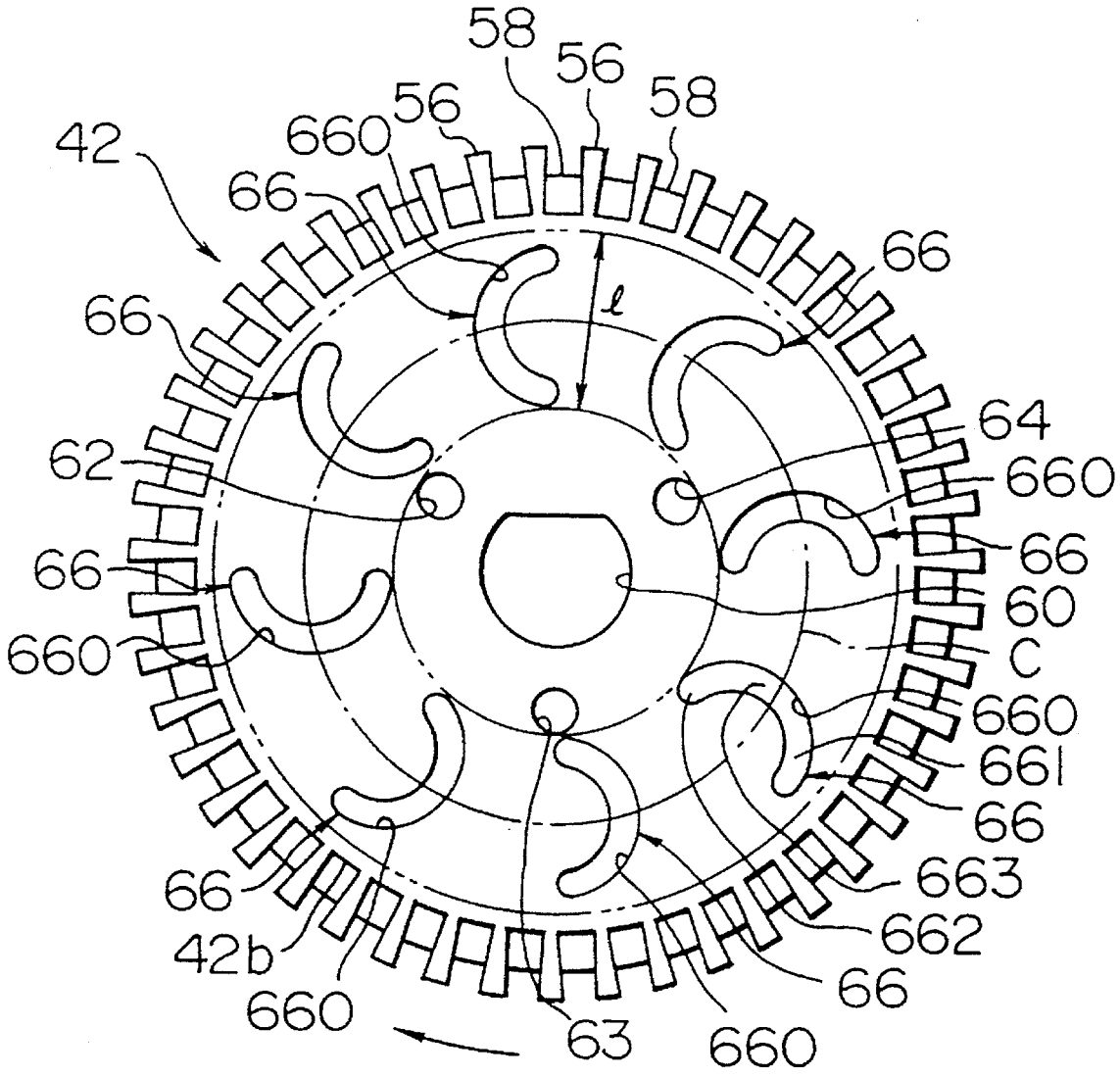
FIG. 1 is a plan view of an impeller of a pump shown in FIG. 2.

The impeller 42 is provided at a part of a periphery thereof with a plurality of vanes 56 and recesses 58 which alternate with each other as shown in FIG. 1. The impeller 42 is provided at a center portion thereof with an axial through hole 60 designed to be engaged with the driving shaft 28 and with pressure relief axial through holes 62, 63 and 64 for reducing the pressure difference between the both sides of the impeller 42.

Furthermore, each end surface 42*a*, 42*b* of the impeller 42 is provided with eight C-shaped grooves each having a U-shaped cross section, which are spaced equiangularly from one another and disposed point symmetrically about a central of rotation of the impeller 42. The C-shaped grooves 66 are oriented so that when the impeller 42 is rotated, the fuel in the U-shaped grooves tends to concentrate at the respective central portion of the C's. The depth of the U-shaped cross section of the C-shaped groove is set to a specific value within a range of 0.01 mm to 0.1 mm. Further, in view of the fact that the end surfaces 42*a* and 42*b* become sliding surfaces, the flatness thereof is maintained at a level of 0.005 mm. In this embodiment, each space 54, 55 is maintained at a small value, e.g., 0.01 mm (0.02 mm for both) or less, which is smaller than that in the conventional Westco-type fuel pump. It is 0.01 mm to 0.02 mm (0.02 mm to 0.04 mm for both) in the conventional Westco-type fuel pump. The C-shaped grooves 66 are disposed plane-symmetrically with respect to a central surface between the end surfaces 42*a* and 42*b* of the impeller 42. All the C-shaped grooves 66 are positioned on the areas of both end surfaces of the impeller 42 facing the corresponding seal surfaces of the pump cover 38 and the pump casing 40, respectively and then communicated with neither a space accommodating the driving shaft 28 nor the pumping chamber 49. This prevents fuel from flowing from the shaft accommodating space to the pumping chamber 49 as well as from flowing reversely, thereby preventing the pumping efficiency from deteriorating. Further, the central portions 663 of the C-shaped grooves 66 are arranged to substantially coincide with a radial center circle C (indicated by a one dot line in FIG. 1) of the seal surface.

With the impeller being rotated rapidly, the C-shaped grooves are moved at high speed relative to the inner wall 38*a* of the pump cover 38 and the inner wall 40*a* of the pump casing 40. Then, the fuel in the C-shaped grooves is, due to its viscosity, moved in the C-shaped grooves while being attracted to the inner wall 38*a* and the inner wall 40*a*, and when it collides against the downstream side walls 660, the velocity components in the axial direction of the impeller 42 towards the pump casing 40 are obtained to generate a force axially urging the pump cover 38 or the pump casing 40. Especially, since the fuel in line-shaped arm portions 661 and 662 of each C-shaped groove 66' concentrates at a central portion 663 and then collides against the downstream side walls or to flow towards the seal surfaces, the fuel in the spaces 54 and 55 is pushed out intensively towards the radial center circle C in FIG. 1. Since the force axially urging the pump cover 38 or the pump casing 40 is generated in the C-shaped grooves formed on the end surfaces 42*a* and 42*b* of the impeller 42, its reaction prevents the impeller 42 from being pushed to adhere to either the pump cover 38 or the pump casing 40. For this reason, even if the spaces 54 and 55 are reduced, since the linking phenomenon hardly occurs, the leakage of the fuel can be reduced, thereby improving the pumping efficiency. Especially in this embodiment, since the fuel in the spaces 54 and 55 is collected within the C-shaped grooves 66 and is forced to intensively flow towards the radial center circle C of the seal surface, a fuel film is formed substantially uniformly between the seal surface and the impeller, thereby enhancing the pumping efficiency even if the spaces 54 and 55 are reduced.

Figure 5:
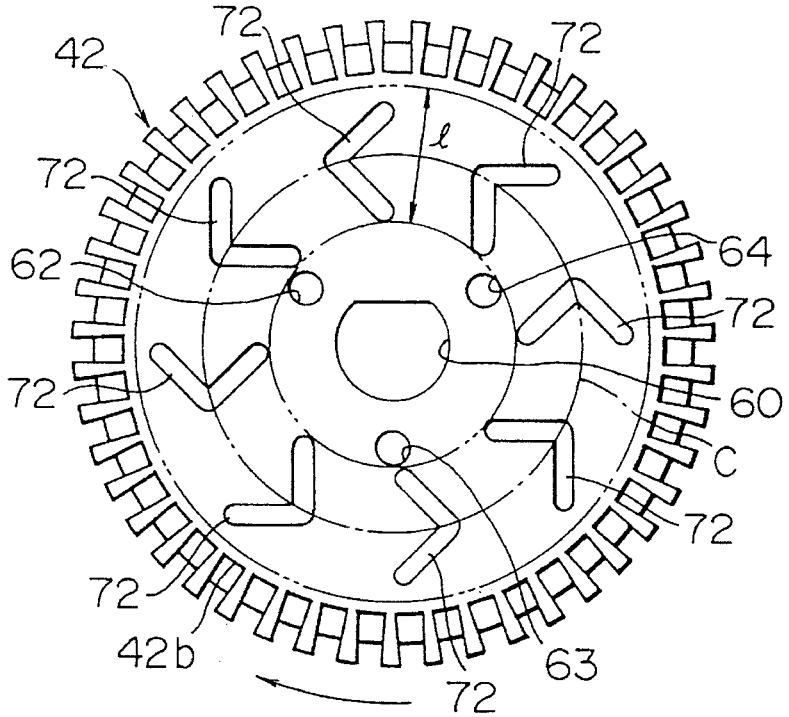
FIGS. 5 and 6 are plan views of an impeller of a Westco-type pump according to a second and a third embodiment of the present invention, respectively.

In a second embodiment of the present invention shown in FIG. 5, instead of the C-shaped grooves 66, V-shaped grooves 72 are formed on each end surface 42*a*, 42*b* of an impeller 42. The V-shaped grooves 72 are arranged in a manner such that when the impeller 42 is rotated, the fuel is moved towards angle portions of the V-shaped grooves 72. This arrangement is the same for the V-shaped grooves on both end surfaces 42*a* and 42*b* of the impeller 42. With these V-shaped grooves 72, due to the pushing out effect of the fuel like as in the first embodiment, at both the space 54 between the impeller 42 and the pump cover 38 and the space 55 between the impeller 42 and the pump casing 40, the adhesion of the impeller 42 to the pump cover 38 or to the pump casing 40 is prevented. This is because the fuel is pushed out from the V-shaped grooves 72 towards the pump cover 38 and the pump casing 40.

Figure 6:
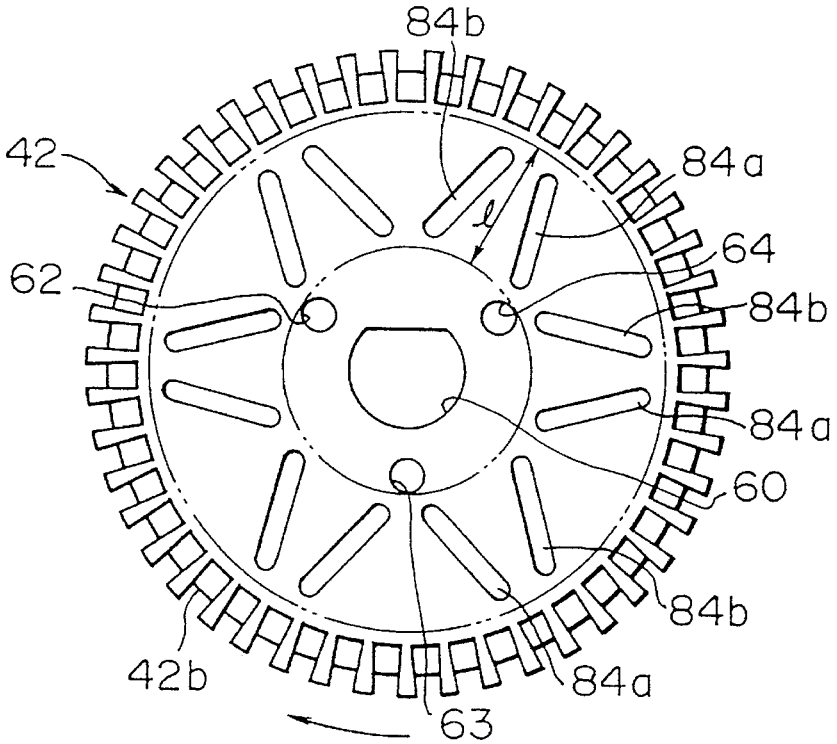

A third embodiment is shown in FIG. 6, in which a plurality of pairs of linear grooves 84*a* and 84*b* are formed around a center of an impeller on both end surfaces 42*a* and 42*b* thereof. Each pair of grooves 84*a* and 84*b* are so arranged that they may converge radially outwardly. These grooves 84*a* and 84*b* are arranged alternately. The grooves 84*a* extend to incline circumferentially outwardly with respect to the direction of rotation of the impeller 42 while the grooves 84*b* extend to incline circumferentially inwardly with respect to the direction of rotation of the impeller 42. In this manner, the two kinds of the grooves 84*a* and 84*b* inclined opposite directions with respect to the direction of rotation of the impeller 42 are formed on both end surfaces 42*a* and 42*b* of the impeller 42 to cause the fuel in the spaces 54 and 55 to flow towards the seal surfaces.

In this embodiment, since the same pattern of grooves are formed on both end surfaces 42*a* and 42*b* of the impeller 42, it is noted that the impeller is assembled into a structure shown in FIG. 2 without care of which is the right side of the impeller. For this reason, it is possible to realize a structure in which the impeller 42 is skimmed with certainty with respect to the seal surfaces formed at the inner wall 38*a* of the pump cover 38 and the inner wall 40*a* of the pump casing 40, without impairing the assembling workability.

Incidentally, it is possible also in the present invention to alternately arrange the C-shaped grooves and the V-shaped grooves used in the first and the second embodiments so that they may orient opposite to each other with respect to the direction of rotation of the impeller. Accordingly it is possible to obtain the excellent fuel energizing action by means of the C-shaped grooves and V-shaped grooves while realizing the assembling operation without care of which is the right side of the impeller.

Also, in the present invention, each C-shaped groove or V-shaped groove may be replaced by a pair of independent grooves arranged corresponding to both arm potions thereof. Further, the V-shaped groove may be replaced with a W-shaped groove or the like.

While in the foregoing embodiments, simple C-shaped or V-shaped grooves are formed on both end surfaces of an impeller to energize the fuel within the spaces 54 and 55 towards the seal surfaces, with taking into consideration the differences in the circumferential velocities on the impeller end surface portions corresponding to the seal surfaces, the width, the depth and the pattern of each groove may be so changed that the fuel energizing force due to lower circumferential velocity at a radial inner portion of the impeller becomes substantially identical to that due to higher circumferential velocity at a radial outer portion of the impeller.

Figure 3:
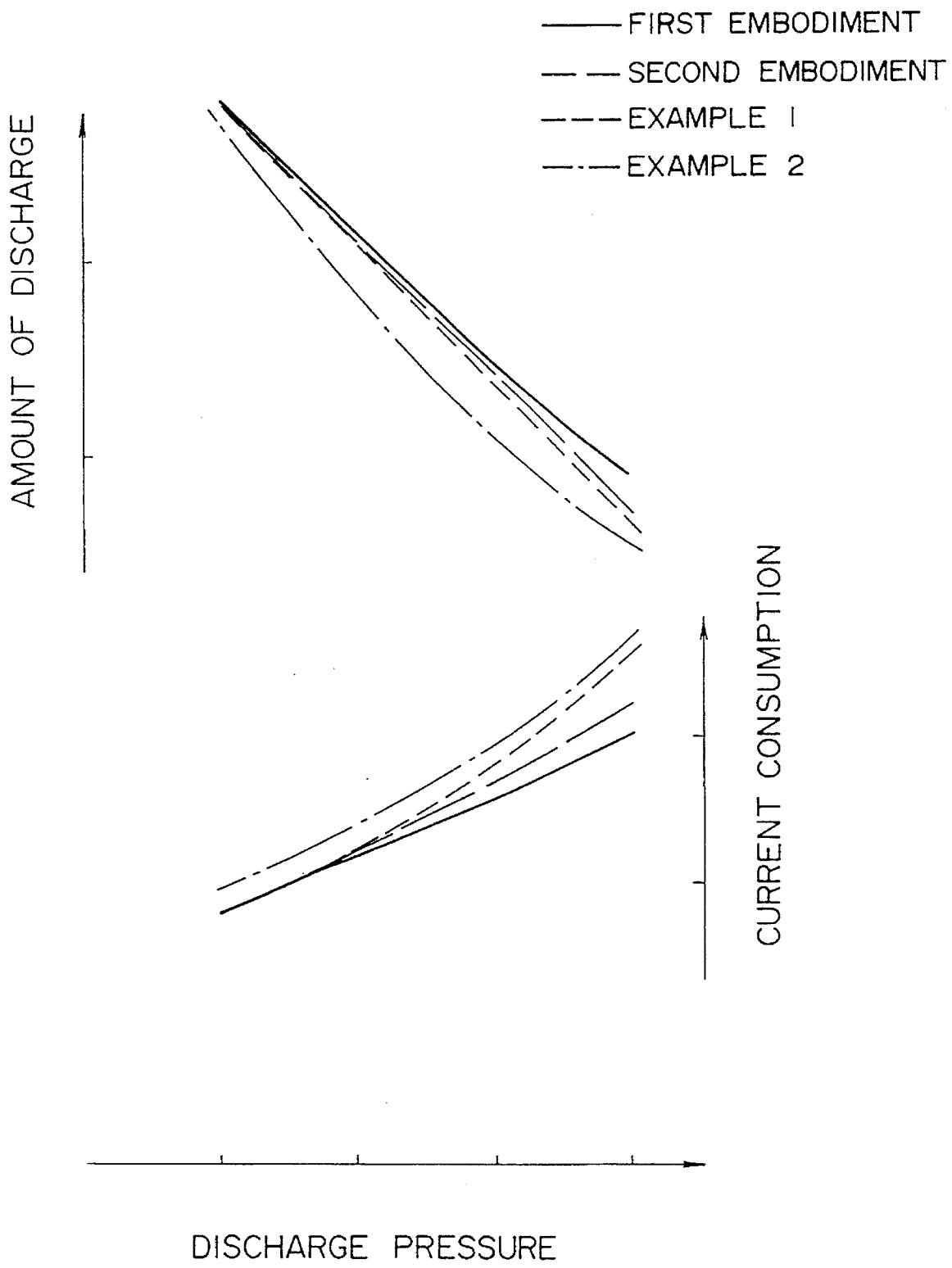
FIG. 3 is a characteristic view illustrating the relationship between the discharge pressure and the discharge quantity and the relationship between the discharge pressure and the electric current consumption.
Figure 4:
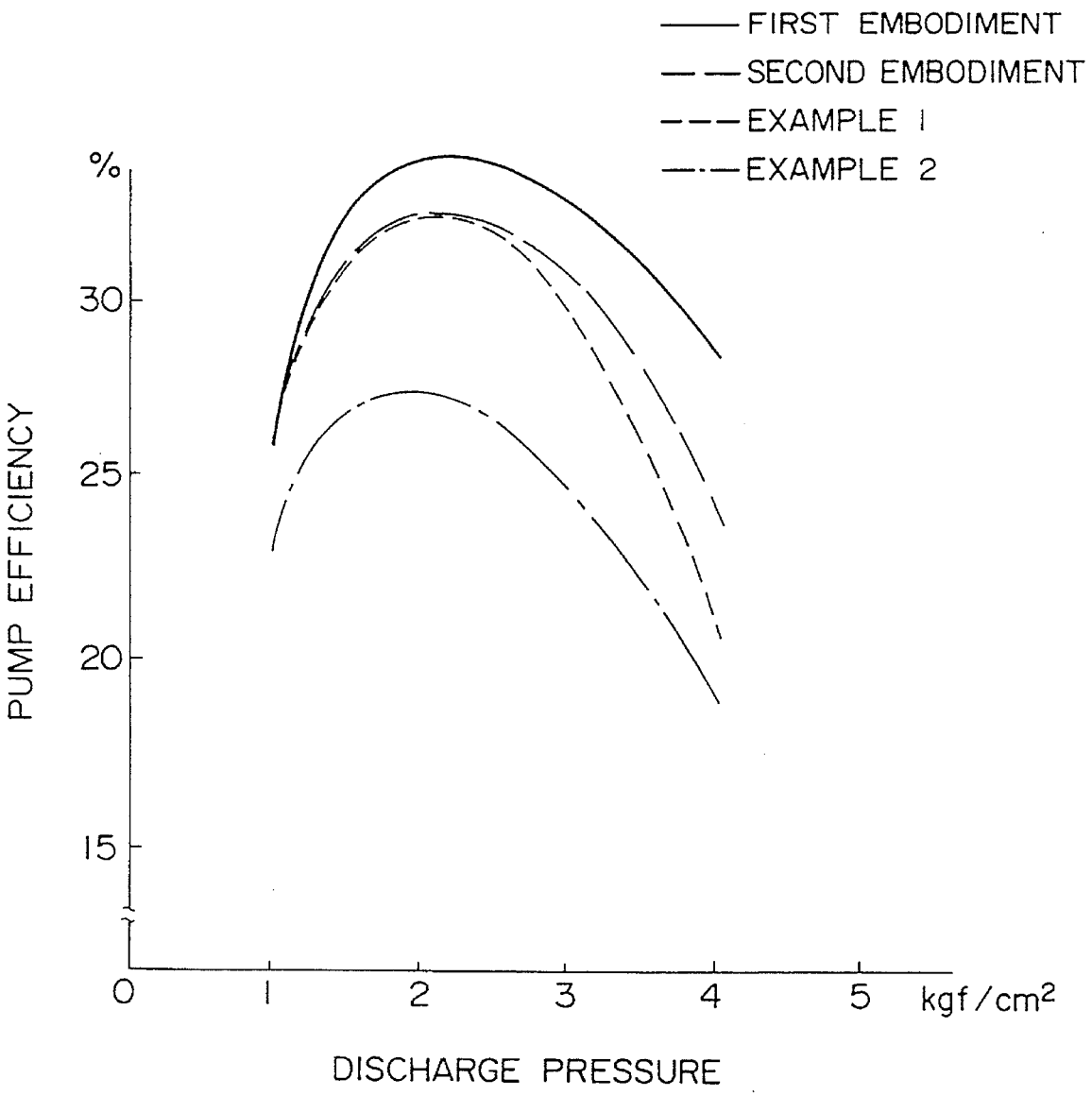
FIG. 4 is a characteristic view illustrating the relationship between the discharge pressure and the pump efficiency.

Next, how the pumping efficiency is significantly improved in the first and the second embodiment will be apparent from FIGS. 3 and 4.

Figure 7:
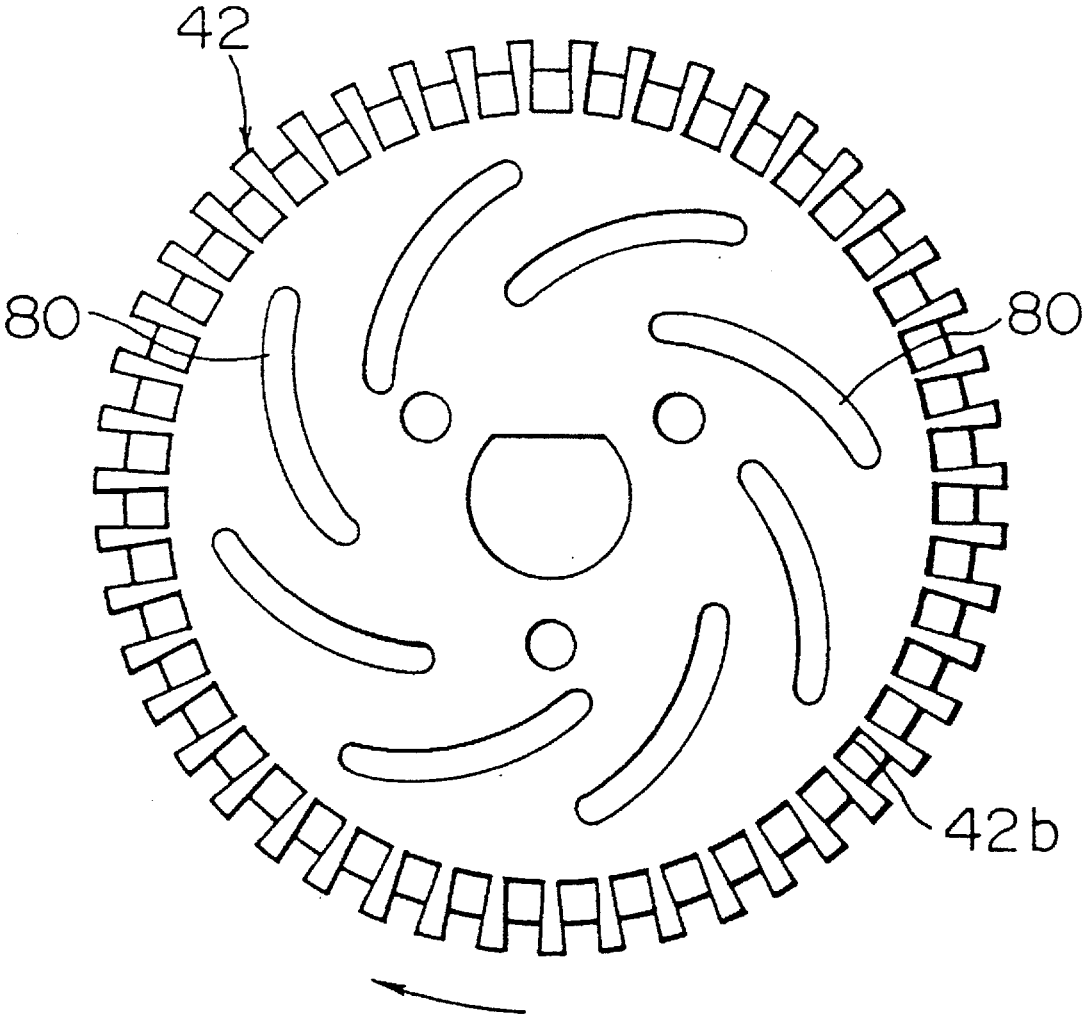
FIG. 7 (PRIOR ART)
FIG. 7 is a plan view of an impeller of a Westco-type pump according to a comparative example.

An explanation will be made on the examples 1 and 2 in comparison with the first and the second embodiments. The comparative example 1 uses an impeller having no groove on either end surface thereof. The comparative example 2 (FIG. 7) uses an impeller having spiral grooves 80 formed on the surfaces 42*a* and 42*b* of the impeller 42. Japanese Unexamined Patent Publication No. 58-24955 and Japanese Unexamined Utility Model Publication No. 57-114195 show the impeller similar to the example 2. The impeller having spiral grooves formed on either end surface thereof can be readily inclined due to slight pressure difference because a fluid unbalance is positively created.

As apparent from FIG. 3, the pumps using the impeller according to the first and the second embodiments have relatively large discharge and less current consumption with respect to the discharge pressure, as compared with the pumps using impeller according to the examples 1 and 2. Further, as shown in FIG. 4, the pumps using impeller according to the first and the second embodiments have higher pumping efficiencies with respect to the discharge pressure, as compared with the pumps using impeller according to the examples 1 and 2.

In the first and the second embodiments, it is considered that the reduction in the pumping efficiency is limited due to the fact that the linking is prevented by the effect of the V-shaped grooves or the C-shaped grooves. In comparison, it is found that the example 2 with the spiral grooves causes the pumping efficiency to be reduced as the discharge pressure becomes higher. This is apparently because a linking develops between the impeller and the pump casing or the pump cover to increase the sliding resistance.

Especially, in the example 2, since the grooves are formed so as to be involuted unidirectional, it is found that the fuel within the spaces 54 and 55 is concentrated at a single portion located eccentrically and then a uniform liquid film is hardly formed between the impeller 42 and the housing, making it liable for the impeller 42 to incline, hence occurring the linking phenomenon. In comparison, with the impeller according to the first or the second embodiment, the C-shaped grooves or V-shaped grooves tend to concentrate the fuel substantially to the radial center circle C and to push it out. Accordingly, it is seen that a substantially uniform liquid film is maintained within the seal surface to limit the inclination of the impeller 42 while the impeller 42 is skimmed with certainty from the inner wall 38*a* of the pump cover 38 and the inner wall 40*a* of the pump casing 40, thus making it not liable that the linking phenomenon occurs. In accordance with the present invention, the grooves formed on both end surfaces of an impeller cause fluid to flow towards seal surfaces with a substantially uniform fluid quantity distribution on the impeller. Accordingly, the liquid film is maintained with certainty between both ends of the impeller and the seal surfaces of the housing to reduce the generation of the linking phenomenon.

What is claimed is:

1. A Westco-type pump for pressurizing a fluid comprising:

a casing having a partial annular pumping chamber connecting an intake port and a discharge port, said casing provided at opposite inner wall surfaces thereof with seal surfaces located radially inward of said pumping chamber;

an impeller rotatably disposed within said casing and having a plurality of vanes facing said pumping chamber and end surfaces separated from said seal surface of said casing by spaces; and grooves provided in portions of said end surfaces of said impeller facing said seal surface of said casing, and said grooves are constructed and arranged to concentrate fluid between said end surfaces of said impeller and said seal surfaces of said casing at edge portions of said grooves so that fluid flows towards said seal surfaces, said grooves being predetermined such that said fluid forms a substantially uniform fluid pressure distribution with respect to a radial center circle of said seal surface; each of said grooves having at least a portion having a first end and a second end, said second end being circumferentially displaced from said first end in the direction of rotation of said impeller, certain of said grooves having said first end displaced radially further from a center of said impeller than said second end, other of said grooves having said second end displaced radially further from said center of said impeller than said first end, each of said grooves communicating exclusively with one of said spaces between one of said seal surfaces of said casing and one of said end surfaces of said impeller, respectively.

2. A Westco-type pump according to claim 1, wherein said impeller is disk-shaped and provided at both end surfaces thereof with impeller grooves symmetrically, and said casing is positioned at both sides of said impeller and has said pumping chamber and said seal surface opposite to said both sides of the impeller, and said grooves are formed on the both sides of said impeller.

3. An impeller of a Westco-type pump for pressurizing a fluid, said impeller comprising:

a plurality of impeller vanes facing a partial annular pumping chamber defined by a casing;

end surfaces separated from seal surfaces of said casing by small axial spaces; and grooves formed in portions of said end surfaces facing said seal surfaces of said casing, said grooves being constructed and arranged to concentrate fluid between said end surfaces of said impeller and said seal surfaces of said casing at edge portions of said grooves so that fluid flows towards said seal surfaces, said grooves being predetermined such that said fluid forms a substantially uniform fluid pressure distribution with respect to a radial center circle of said seal surface; each of said grooves having at least a portion having a first end and a second end, said second end being circumferentially displaced from said first end in the direction of rotation of said impeller, certain of said grooves having said first end displaced radially further from a center of said impeller than said second end, other of said grooves having said second end displaced radially further from said center of said impeller than said first end, each of said grooves communicating exclusively with one of said spaces between one of said seal surfaces of said casing and one of said end surfaces of said impeller, respectively.

4. An impeller according to claim 3, wherein said impeller is disk-shaped and provided at both end surfaces thereof with impeller grooves symmetrically, and said casing is positioned at both sides of said impeller and has said pumping chamber and said seal surface opposite to said both sides of the impeller, and said grooves are formed on the both sides of said impeller.

5. A fuel pump for feeding fuel to an internal combustion engine including:

a motor portion;

a pump portion integrally assembled with said motor portion;

an impeller provided in said pump portion for being rotationally driven by said motor portion and provided at end surfaces thereof with a plurality of vanes and a plurality of impeller grooves alternately arranged with respect to each other;

a casing defining a C-shaped pumping chamber facing said vanes and having seal surfaces facing said end surfaces of said impeller through axial spaces, thereby confining the fuel in said pumping chamber; and grooves formed in portions of said end surfaces of said impeller facing said seal surfaces of said casing, said grooves being constructed and arranged to concentrate a fluid between said end surfaces of said impeller and said seal surfaces of said casing at edge portions of said grooves so that fluid flows towards said seal surfaces, said grooves being predetermined such that said fluid forms a substantially uniform fluid pressure distribution with respect to a radial center circle of said seal surface; each of said grooves having at least a portion having a first end and a second end, said second end being circumferentially displaced from said first end in the direction of rotation of said impeller, certain of said grooves having said first end displaced radially further from a center of said impeller than said second end, other of said grooves having said second end displaced radially further from said center of said impeller than said first end, each of said grooves communicating exclusively with one of said spaces between one of said seal surfaces of said casing and one of said end surfaces of said impeller, respectively.

6. A fuel pump according to claim 5, wherein said impeller includes annular end surface portions at said end surfaces thereof between said plurality of vanes and said grooves and facing said seal surfaces through said small axial spaces to prevent the fuel from directly flowing into said grooves from said pumping chamber.

7. A Westco-type pump for pressurizing a fluid comprising:

a casing having a partial annular pumping chamber connecting an intake port and a discharge port, said casing provided at opposite inner wall surfaces thereof with seal surfaces located radially inward of said pumping chamber;

an impeller rotatably disposed within said casing and having a plurality of vanes facing said pumping chamber and end surfaces separated from said seal surface of said casing by spaces; and grooves provided in portions of said end surfaces of said impeller facing said seal surface of said casing, and said grooves are constructed and arranged to concentrate fluid between said end surfaces of said impeller and said seal surfaces of said casing at edge portions of said grooves so that fluid flows towards said seal surfaces in a direction generally perpendicular to said end surfaces of said impeller, said grooves being predetermined such that said fluid forms a substantially uniform fluid pressure distribution with respect to a radial center circle of said seal surface, said grooves being disposed in spaced circumferential pairs about said impeller, at least portions of said grooves of each of said pairs converging radially outwardly, each of said grooves having a constant depth, first and second radially spaced end portions and a central portion spaced circumferentially from said end portions, said central portion defining a trailing edge of each said groove, each of said grooves communicating exclusively with one of said spaces between one of said seal surfaces of said casing and one of said end surfaces of said impeller, respectively.

8. A Westco-type pump according to claim 7, wherein each of said grooves has a pair of arm portions.

9. A Westco-type pump according to claim 8, wherein said edge portions of said arm portions are positioned substantially on a radial center circle of said seal surface.

10. A Westco-type pump according to claim 9, wherein said arm portions are connected with each other.

11. A Westco-type pump according to claim 8, wherein said edge portions of said arm portions are located at a radial inner portion and a radial outer portion of said end surface of said impeller, respectively.

12. A Westco-type pump according to claim 8, wherein each of said grooves is C-shaped or V-shaped.

13. An impeller of a Westco-type pump for pressurizing a fluid, said impeller comprising:

a plurality of impeller vanes facing a partial annular pumping chamber defined by a casing;

end surfaces separated from seal surfaces of said casing by small axial spaces; and grooves formed in portions of said end surfaces facing said seal surfaces of said casing, said grooves being constructed and arranged to concentrate fluid between said end surfaces of said impeller and said seal surfaces of said casing at edge portions of said grooves so that fluid flows towards said seal surfaces in a direction generally perpendicular to said end surfaces of said impeller, said grooves being predetermined such that said fluid forms a substantially uniform fluid pressure distribution with respect to a radial center circle of said seal surface, said grooves being disposed in spaced circumferential pairs about said impeller, at least portions of said grooves of each of said pairs converging radially outwardly, each of said grooves having a constant depth, first and second radially spaced end portions and a central portion spaced circumferentially from said end portions, said central portion defining a trailing edge of each said groove, each of said grooves communicating exclusively with one of said spaces between one of said seal surfaces of said casing and one of said end surfaces of said impeller, respectively.

14. An impeller according to claim 13, wherein each of said grooves has a pair of arm positions.

15. An impeller according to claim 14, wherein said edge portions of said arm portions are positioned substantially on a radial center circle of said seal surface.

16. An impeller according to claim 15, wherein said arm portion are connected with each other.

17. An impeller according to claim 14, wherein said edge portions of said arm portions are located at a radial inner portion and a radial outer portion of said end surface of said impeller, respectively.

18. A Westco-type pump according to claim 14, wherein each of said grooves is C-shaped or V-shaped.

19. A fuel pump for feeding fuel to an internal combustion engine including:

a motor portion;

a pump portion integrally assembled with said motor portion;

an impeller provided in said pump portion for being rotationally driven by said motor portion and provided at end surfaces thereof with a plurality of vanes and a plurality of impeller grooves alternately arranged with respect to each other;

a casing defining a C-shaped pumping chamber facing said vanes and having seal surfaces facing said end surfaces of said impeller through axial spaces, thereby confining the fuel in said pumping chamber; and grooves formed in portions of said end surfaces of said impeller facing said seal surfaces of said casing, said grooves being constructed and arranged to concentrate fluid between said end surfaces of said impeller and said seal surfaces of said casing at edge portions of said grooves so that fluid flows towards said seal surfaces in a direction generally perpendicular to said end surfaces of said impeller, said grooves being predetermined such that said fluid forms a substantially uniform fluid pressure distribution with respect to a radial center circle of said seal surface;

said grooves being disposed in spaced circumferential pairs about said impeller, at least portions of said grooves of each of said pairs converging radially outwardly, each of said grooves having a constant depth, first and second radially spaced and portions and a central portion spaced circumferentially from said end portion, said central portion defining a trailing edge of each said groove, each of said grooves communicating exclusively with one of said spaces between one of said seal surfaces of said casing and one of said end surfaces of said impeller, respectively.

20. A fuel pump according to claim 19, wherein each of said grooves has a pair of arm portions.

21. A fuel pump according to claim 20, wherein said space between said impeller and said casing is not greater than 0.01 mm.

* * * * *